US009518523B2

(12) United States Patent
Ikeda et al.

(10) Patent No.: US 9,518,523 B2
(45) Date of Patent: Dec. 13, 2016

(54) AIR-FUEL RATIO IMBALANCE DETECTION DEVICE FOR INTERNAL COMBUSTION ENGINE

(75) Inventors: Shinji Ikeda, Mishima (JP); Takeshi Sano, Hadano (JP); Kazumasa Shimode, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 86 days.

(21) Appl. No.: 14/117,489

(22) PCT Filed: May 16, 2011

(86) PCT No.: PCT/JP2011/061193

§ 371 (c)(1),
(2), (4) Date: Nov. 13, 2013

(87) PCT Pub. No.: WO2012/157067

PCT Pub. Date: Nov. 22, 2012

(65) Prior Publication Data

US 2014/0290622 A1 Oct. 2, 2014

(51) Int. Cl.
*F02D 41/30* (2006.01)
*F02D 41/00* (2006.01)
(Continued)

(52) U.S. Cl.
CPC ..... *F02D 41/30* (2013.01); *F02D 35/023* (2013.01); *F02D 41/0085* (2013.01); *F02D 41/1454* (2013.01); *F02D 41/1475* (2013.01)

(58) Field of Classification Search
CPC ..... F02D 35/02; F02D 35/021; F02D 35/022; F02D 41/008; F02D 41/0085; F02D 41/1475; F02D 41/30
(Continued)

(56) References Cited

U.S. PATENT DOCUMENTS 5,947,077 A * 9/1999 Yonezawa ..... F02D 37/02 123/295
6,694,960 B2 * 2/2004 Hess ..... F02D 35/023 123/436
(Continued)

FOREIGN PATENT DOCUMENTS

DE 10339251 A1 * 3/2005 ..... F02D 41/40
DE 102004044808 A1 * 4/2006 ..... F02D 41/00
(Continued)

*Primary Examiner* — Stephen K Cronin
*Assistant Examiner* — Kevin R Steckbauer
(74) *Attorney, Agent, or Firm* — Finnegan, Henderson, Farabow, Garrett & Dunner, LLP

(57) ABSTRACT

A plurality of cylinders are provided. An in-cylinder pressure sensor is mounted on each of the plurality of cylinders. A combustion parameter (e.g., the amount of generated heat) is calculated from the output of the in-cylinder pressure sensor. The air-fuel ratio for a cylinder is enleaned by reducing a fuel injection amount until the combustion parameter coincides with a predetermined value. Each cylinder is subjected to fuel injection amount reduction control so that the combustion parameter coincides with the predetermined value. The air-fuel ratio for each cylinder is then calculated in accordance with the reduction amount of fuel injection amount. The calculated air-fuel ratios are compared to detect an air-fuel ratio imbalance between the cylinders.

7 Claims, 6 Drawing Sheets

(51) Int. Cl.
*F02D 35/02* (2006.01)
*F02D 41/14* (2006.01)

(58) Field of Classification Search
USPC ..... 123/435, 436, 673; 73/35.03, 35.04, 73/35.06, 114.02, 114.16, 114.17
See application file for complete search history.

(56) References Cited

U.S. PATENT DOCUMENTS 6,976,936 B2 * 12/2005 Yamaoka ..... B60W 10/10 123/305
7,055,492 B2 * 6/2006 Yamaoka et al. ..... 123/295
7,207,316 B2 * 4/2007 Moriya ..... F02D 41/40 123/435
7,380,540 B1 * 6/2008 Duffy et al. ..... 123/435
7,469,181 B2 * 12/2008 Duffy ..... F02D 41/0065 123/305
7,549,414 B2 * 6/2009 Moriya ..... F02D 35/023 123/435
8,316,821 B2 * 11/2012 Lee ..... F02D 41/0085 123/339.14
8,401,766 B2 * 3/2013 Iwazaki ..... F02D 41/0085 123/697
8,413,497 B2 * 4/2013 Kayama ..... F02D 41/22 73/114.72
8,437,944 B2 * 5/2013 Hirata ..... F02D 41/2454 123/299
8,700,290 B2 * 4/2014 Miyamoto ..... F02D 41/0037 123/674
8,899,212 B2 * 12/2014 Leone ..... F02D 41/062 123/442
9,127,601 B2 * 9/2015 Cowgill ..... F02D 41/0085
9,279,377 B2 * 3/2016 Genko ..... F02D 41/1454
2008/0178843 A1 * 7/2008 Duffy et al. ..... 123/435
2008/0178848 A1 * 7/2008 Duffy ..... F02D 41/0065 123/481
2011/0219861 A1 * 9/2011 Kayama ..... F02D 41/22 73/114.72
2011/0239984 A1 * 10/2011 Lee ..... F02D 41/0085 123/339.14
2012/0022772 A1 * 1/2012 Miyamoto ..... F02D 41/0037 701/104
2012/0323466 A1 * 12/2012 Iwazaki ..... F02D 41/0085 701/104
2013/0197782 A1 * 8/2013 Genko ..... F02D 41/1454 701/103
2013/0304356 A1 * 11/2013 Kawakatsu ..... F02D 41/008 701/103
2013/0317723 A1 * 11/2013 Deubler ..... F02D 41/0085 701/104
2014/0046571 A1 * 2/2014 Cowgill ..... F02D 41/0085 701/102
2015/0007642 A1 * 1/2015 Angeby ..... G01L 23/221 73/114.01
2015/0075507 A1 * 3/2015 Iwase ..... F02D 41/0085 123/673

FOREIGN PATENT DOCUMENTS

JP 2007-255237 10/2007
JP 2011-157852 8/2011

* cited by examiner

AIR-FUEL RATIO IMBALANCE DETECTION DEVICE FOR INTERNAL COMBUSTION ENGINE

CROSS-REFERENCE TO RELATED APPLICATIONS

This application is a national phase application of International Application No. PCT/JP2011/061193, filed May 16, 2011, the content of which is incorporated herein by reference.

TECHNICAL FIELD

The present invention relates to an air-fuel ratio imbalance detection device for an internal combustion engine.

BACKGROUND ART

As disclosed in JP-A-2007-255237, for example, there has been conventionally known an internal combustion engine having a plurality of cylinders, in which a control device is provided for addressing an air-fuel ratio (A/F) difference between the cylinders. In an internal combustion engine having a plurality of cylinders, actual intake air amount is not always equal with each other and varies between the cylinders. The reason is considered that, for example, the shape or length of an intake pipe of an intake manifold varies between cylinders.

As the intake air amount varies between cylinders, the air-fuel ratios for the individual cylinders deviate from a target air-fuel ratio, that is, from an optimum air-fuel ratio, no matter whether the whole internal combustion engine is controlled to provide the target air-fuel ratio. Such inter-cylinder variation in air-fuel ratio is likely to adversely affect exhaust emission control performance. Further, from the viewpoint of fuel efficiency improvement, it is demanded that ignition timing be accurately controlled to provide the MBT (Minimum advance for Best Torque), that is, optimum ignition timing for torque maximization. As the MBT varies with the intake air amount and air-fuel ratio, fuel efficiency also may be adversely affected if the intake air amount or air-fuel ratio varies between cylinders. Under these circumstances, it is preferred that an inter-cylinder variation (imbalance) in air-fuel ratio be accurately detected.

In view of the above circumstances, the aforementioned control device for the internal combustion engine based on a conventional technology calculates the values of Wiebe function parameters for formulating a heat generation model based on each cylinder's actual heat generation rate which is calculated from the actual in-cylinder pressure for each cylinder. The actual in-cylinder pressure for each cylinder is calculated based on the output value of an in-cylinder pressure sensor mounted on each cylinder. Inter-cylinder variation in intake air amount can be accurately estimated based on the correspondence between the Wiebe function parameter values and an air amount index value which is an index for an in-cylinder intake air amount.

PRIOR ART LITERATURE

Patent Document

Patent Document 1: JP-A-2007-255237

SUMMARY OF THE INVENTION

Problem to be Solved by the Invention

For accurate evaluation of an air-fuel ratio (A/F) imbalance (variation) between the cylinders, it is demanded that the air-fuel ratios for the cylinders be measured accurately on an individual basis. In recent years, it is increasingly expected that an in-cylinder pressure sensor will meet such a demand. The reason is that the combustion state within each cylinder can be detected accurately and individually by employing the configuration in which each cylinder is provided with an in-cylinder pressure sensor.

It is conceivable that a technology for detecting the air-fuel ratio for each cylinder with an in-cylinder pressure sensor may use various numerical values (hereinafter may be referred to as the "combustion parameters") derived from the output of the in-cylinder pressure sensor. The numerical values include an in-cylinder pressure (e.g., maximum in-cylinder pressure), internal energy, indicated torque (work), a burning velocity, and the amount of generated heat. However, the inventors of the present invention have found, as a result of intensive studies, that these combustion parameters tend to have a decreased sensitivity to air-fuel ratio changes within a certain rich air-fuel ratio region (or more specifically, at an air-fuel ratio of approximately 13). Without considering the above-mentioned tendency, it is difficult to achieve air-fuel ratio imbalance detection with high accuracy if an attempt is made to detect an air-fuel ratio imbalance by using relatively inaccurate combustion parameters derived from a rich air-fuel ratio region. As a result of intensive studies conducted in view of the above circumstances, the inventors of the present invention have found a novel idea that makes it possible to accurately detect an air-fuel ratio imbalance between the cylinders by using an in-cylinder pressure sensor.

An object of the present invention is to provide an air-fuel ratio imbalance detection device that is capable of accurately detecting an air-fuel ratio imbalance between cylinders of an internal combustion engine by using an in-cylinder pressure sensor.

Solution to Problem

To achieve the above-mentioned purpose, a first aspect of the present invention is an air-fuel ratio imbalance detection device for an internal combustion engine, comprising:

output acquisition means for acquiring an output from an in-cylinder pressure sensor mounted on each of a plurality of cylinders of the internal combustion engine;

calculation means for calculating a combustion parameter indicative of a combustion status within the plurality of cylinders based on an output of the in-cylinder pressure sensor, the output being acquired by the output acquisition means;

injection amount control means for providing control to enlean an air-fuel ratio for each of the plurality of cylinders by reducing a fuel injection amount so that the combustion parameter calculated by the calculation means coincides with a predetermined value; and imbalance detection means for detecting an air-fuel ratio imbalance between the plurality of cylinders based on a reduction amount of fuel injection amount, the reduction amount being provided by control that is exercised for each of the plurality of cylinders by the injection amount control means.

A second aspect of the present invention is the air-fuel ratio imbalance detection device for an internal combustion engine, according to the first aspect, further comprising:

an air-fuel ratio sensor disposed in an exhaust path into which exhaust gas from the plurality of cylinders is introduced; and predetermined value calculation means for calculating the predetermined value with which the combustion parameter should coincide under the control by the injection amount control means based on a ratio and an average value, the ratio being between an air-fuel ratio value that is obtained based on the output of the air-fuel ratio sensor and a predetermined lean air-fuel ratio value, the average value being a value of the combustion parameters for the plurality of cylinders.

A third aspect of the present invention is the air-fuel ratio imbalance detection device for an internal combustion engine, according to the first or the second aspect, wherein the injection amount control means includes:

reduction means for reducing the fuel injection amount for each of the plurality of cylinders;

comparison means for comparing the combustion parameter against the predetermined value after a start of reduction by the reduction means; and termination means for terminating the reduction by the reduction means based on a result of the comparison.

A fourth aspect of the present invention is the air-fuel ratio imbalance detection device according to the third aspect, wherein the injection amount control means includes:

means for calculating an air-fuel ratio for a cylinder subjected to fuel injection amount reduction by the reduction means, based on the reduction amount of fuel injection amount from a start of the fuel injection amount reduction by the reduction means to an end of the fuel injection amount reduction by the termination means.

A fifth aspect of the present invention is the air-fuel ratio imbalance detection device according to the third aspect, wherein the reduction means includes:

means for reducing the fuel injection amount by a predetermined amount at a beginning of fuel injection amount reduction; and reduction amount increase means for increasing an amount of the reduction when the result of comparison made by the comparison means indicates that the combustion parameter is greater than the predetermined value.

A sixth aspect of the present invention is the air-fuel ratio imbalance detection device for an internal combustion engine, according to any one of the first to fifth aspect, wherein the injection amount control means includes:

means for reducing the fuel injection amounts for the plurality of cylinders so that the combustion parameter for a target cylinder coincides with a predetermined value, the target cylinder being selected from the plurality of cylinders; and wherein the imbalance detection means includes:

means for selecting a target cylinder from the plurality of cylinders in such a manner that each of the plurality of cylinders is selected at least once as the target cylinder;

means for calculating the reduction amount of fuel injection amount for the target cylinder around the control by the injection amount control means for the target cylinder;

means for acquiring a calculated value of an air-fuel ratio for the target cylinder based on the reduction amount of fuel injection amount, the calculated value of the air fuel ratio being an air fuel ratio of the target cylinder before the target cylinder is controlled by the injection amount control means; and means for detecting an air-fuel ratio imbalance between the plurality of cylinders based on a comparison of the calculated values of the air-fuel ratios between the plurality of cylinders.

A seventh aspect of the present invention is the air-fuel ratio imbalance detection device according to any one of the first to sixth aspects, wherein the combustion parameter is at least one of quantities selected from a group of an in-cylinder pressure, internal energy, indicated torque, indicated work, a burning velocity, and the amount of generated heat, or a physical quantity correlated with at least one of the quantities selected from the group.

Advantages of the Invention

According to the first aspect of the present invention, an air-fuel ratio imbalance can be detected, based on a decrease in the fuel injection amount during a control process of enleaning the air-fuel ratio. This makes it possible to accurately detect an air-fuel ratio imbalance between the cylinders by using the in-cylinder pressure sensor.

According to the second aspect of the present invention, target values of the combustion parameters for the predetermined lean air-fuel ratio can be calculated during an operation of the internal combustion engine by using the "average air-fuel ratio detected from the exhaust gas in the plurality of cylinders" and the "average values of the combustion parameters for the plurality of cylinders."

The third aspect of the present invention can accurately judge whether the combustion parameters coincide with predetermined values in each cylinder, and thereby the air-fuel ratio can be steadily enleaned to obtain a desired lean air-fuel ratio.

According to the fourth aspect of the present invention, air-fuel ratio information to be used for air-fuel ratio imbalance detection can be accurately calculated on an individual cylinder basis by precisely determining a decrease (a change) in the fuel injection amount.

According to the fifth aspect of the present invention, the result of comparison between the combustion parameters and predetermined values can be properly fed back to fuel injection amount reduction control.

According to the sixth aspect of the present invention, the air-fuel ratio information to be used for air-fuel ratio imbalance detection can be acquired on an individual cylinder basis while changing the target cylinder.

According to the seventh aspect of the present invention, an air-fuel ratio imbalance can be detected by using general combustion parameters indicative of a combustion state within the internal combustion engine or by using physical quantities correlated with the combustion parameters.

MODE FOR CARRYING OUT THE INVENTION

First Embodiment

Figure 1:
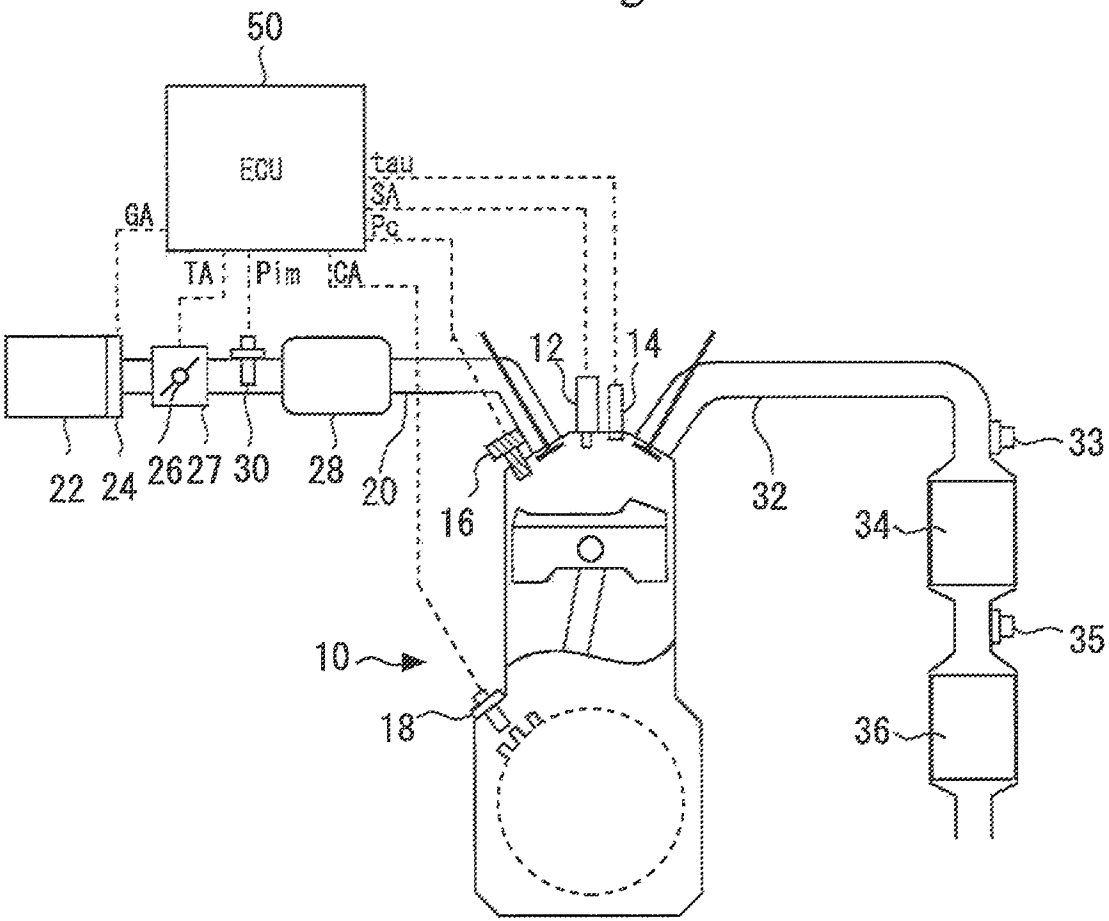
FIG. 1 is a schematic diagram illustrating not only the configuration of an air-fuel ratio imbalance detection device according to a first embodiment of the present invention, which is used for an internal combustion engine, but also the configuration of an internal combustion engine system to which the air-fuel ratio imbalance detection device is applied.

FIG. 1 is a schematic diagram illustrating not only the configuration of an air-fuel ratio imbalance detection device according to a first embodiment of the present invention, which is used for an internal combustion engine, but also the configuration of an internal combustion engine system to which the air-fuel ratio imbalance detection device is applied. The system shown in FIG. 1 includes an internal combustion engine (hereinafter simply referred to as the engine) 10. The engine 10 shown in FIG. 1 is a spark-ignition four-stroke engine having an ignition plug 12. The engine 10 is also an in-cylinder direct-injection engine having a direct-injection injector 14 that directly injects fuel into a cylinder. The air-fuel ratio imbalance detection device according to the first embodiment is implemented as one function of an ECU (Electronic Control Unit) that provides overall operational control of the engine 10.

Although only one cylinder is shown in FIG. 1, the engine 10 according to embodiments of the present invention is an in-line four-cylinder engine having four cylinders (cylinders #1 to #4). Engines for vehicles generally have a plurality of cylinders. The engine 10 similarly has a plurality of cylinders. The direct-injection injector 14 of each cylinder is connected to a common delivery pipe (not shown). The delivery pipe is connected to a fuel tank (not shown).

Each cylinder is also provided with an in-cylinder pressure sensor (CPS (Combustion Pressure Sensor)) 16 that detects an in-cylinder pressure (a combustion pressure). The engine 10 is also provided with a crank angle sensor 18 that outputs a signal CA in accordance with a crank angle θ

An intake system for the engine 10 includes an intake path 20 that is connected to each cylinder. An air cleaner 22 is disposed at the inlet of the intake path 20. An air flow meter 24 is disposed downstream of the air cleaner 22 to output a signal GA in accordance with the flow rate of air taken into the intake path 20. An electronically-controlled throttle valve 26 is disposed downstream of the air flow meter 24. A throttle opening sensor 27 is disposed near the throttle valve 26 to output a signal TA in accordance with the degree of opening of the throttle valve 26. A surge tank 28 is disposed downstream of the throttle valve 26. An intake pressure sensor 30 is disposed near the surge tank 28 to measure an intake pressure.

An exhaust system for the engine 10 includes an exhaust path 32 that is connected to each cylinder. Specifically, the exhaust path 32 includes an exhaust manifold and an exhaust pipe. Exhaust ports of cylinders #1 to #4 merge with the exhaust manifold. The exhaust pipe is connected to the exhaust manifold. Catalysts 34, 36 are disposed in the exhaust path 32. For example, three-way catalysts, NOx catalysts, or other catalysts appropriate for the employed system are used as the catalysts 34, 36. A catalyst upstream exhaust sensor 33 and a catalyst downstream exhaust sensor 35 are disposed in the exhaust path 32. The catalyst upstream exhaust sensor 33 is a so-called air-fuel ratio (A/F) sensor capable of linearly detecting an oxygen concentration. Specifically, a limited-current air-fuel ratio sensor or various other air-fuel ratio sensors may be used as the catalyst upstream exhaust sensor 33. There is a known system that provides sub-feedback air-fuel ratio control with a so-called sub-oxygen sensor. In the present embodiment, the catalyst downstream exhaust sensor 35 is used as the sub-oxygen sensor. However, the configuration of the exhaust system to which the present invention is applied is not limited to the above-described configuration according to the present embodiment. The present invention can also be applied, for instance, to the exhaust system having only one exhaust path catalyst or having only one exhaust gas sensor.

A control system for the engine 10 includes an ECU (Electronio Control Unit) 50. The input section of the ECU 50 is connected to various sensors such as the aforementioned in-cylinder pressure sensor 16, crank angle sensor 18, air flow meter 24, throttle opening sensor 27, and intake pressure sensor 30. The output section of the ECU 50 is connected to various actuators such as the aforementioned ignition plug 12, direct-injection injector 14, and throttle valve 26. The ECU 50 controls an operating state of the engine 10 in accordance with various items of input information. From the signal CA of the crank angle sensor 18, the ECU 50 can calculate an engine speed (the number of revolutions per unit time) and an in-cylinder volume V that is determined by the position of a piston. In accordance, for instance, with the engine speed, load, and an intake air amount, the ECU 50 calculates a proper fuel injection amount providing a target air-fuel ratio appropriate for a prevailing operating state, and then causes the direct-injection injector 14 to inject fuel accordingly.

The ECU 50 stores a calculation program that calculates combustion parameters, which are values representing the status of in-cylinder combustion, in accordance with an output of the in-cylinder pressure sensor 16. The output of the in-cylinder pressure sensor 16 is sampled at predetermined intervals (at predetermined crank angles). Measured data based on such a sampled value can be used as an input value for the calculation program. In the present embodiment, it is assumed that the ECU 50 executes a program for calculating the amount of generated heat Q, as a combustion parameter, in accordance with the output of the in-cylinder pressure sensor 16. The calculation program for calculating the combustion parameters may be prepared, stored, and executed by using various publicly known technologies so that calculations are performed in accordance with various publicly known calculation formulas. The technologies for implementing the calculation program will not be described in detail because they are not novel technologies.

[Operation of First Embodiment]

Figure 2:
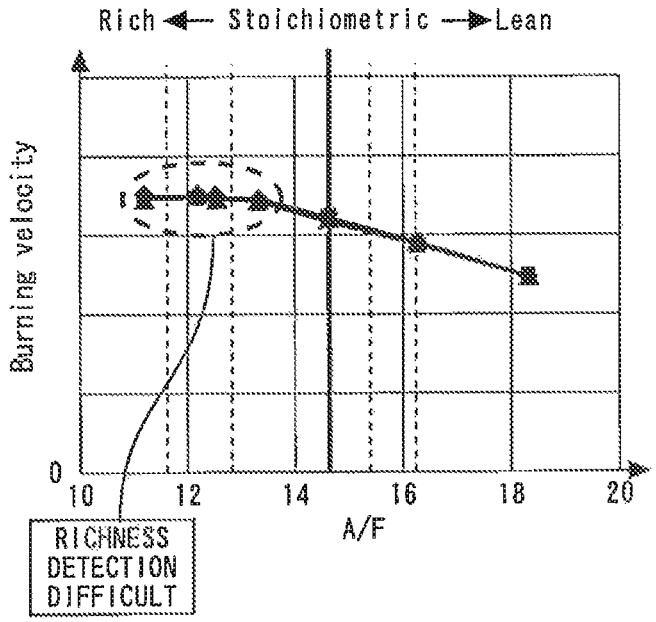
FIG. 2 is a diagram illustrating a control operation performed by the air-fuel ratio imbalance detection device for an internal combustion engine, according to the first embodiment of the present invention.
Figure 3:
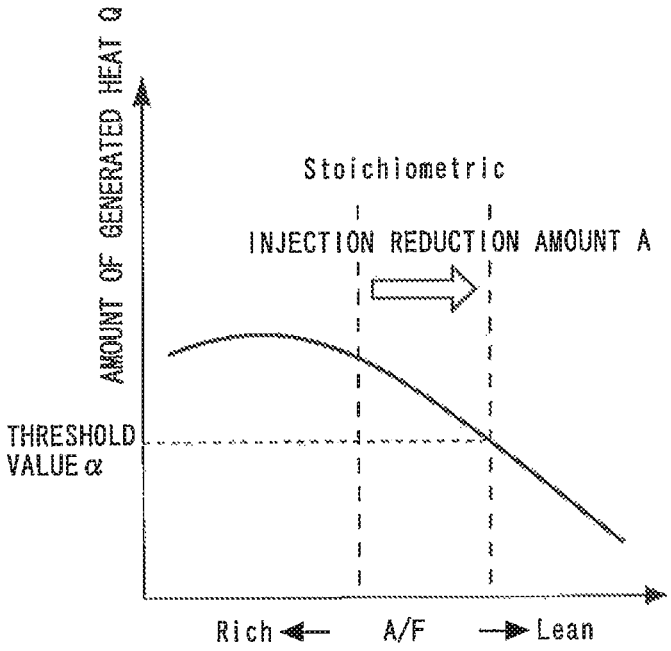
FIG. 3 is a diagram illustrating a control operation performed by the air-fuel ratio imbalance detection device for an internal combustion engine, according to the first embodiment of the present invention.
Figure 4:
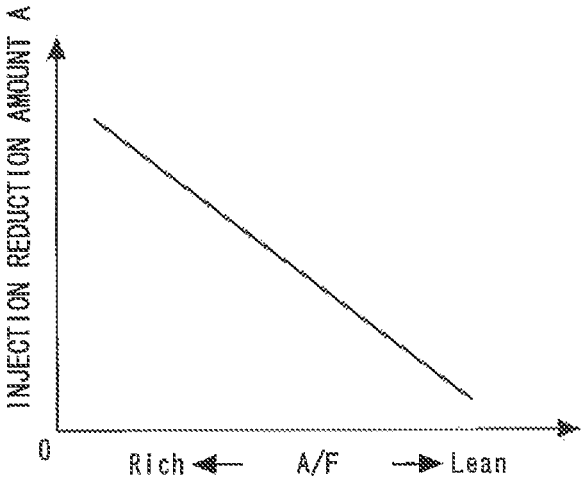
FIG. 4 is a diagram illustrating a control operation performed by the air-fuel ratio imbalance detection device for an internal combustion engine, according to the first embodiment of the present invention.

FIGS. 2 to 4 are diagrams illustrating a control operation performed by the air-fuel ratio imbalance detection device for an internal combustion engine, according to the first embodiment (that is, "air-fuel ratio imbalance detection control according to the first embodiment").

FIG. 2 is a diagram illustrating a problem that is addressed by the air-fuel ratio imbalance detection device for an internal combustion engine, according to the first embodiment. More specifically, this diagram illustrates the reason why the problem arises. As indicated by "Richness detection difficult" in FIG. 2, the sensitivity (change rate) of a burning velocity relative to an air-fuel ratio change in a particular rich region (specifically, at an air-fuel ratio of approximately 13) is lower than the sensitivity (change rate) of the burning velocity relative to an air-fuel ratio change toward the lean side. The inventors of the present invention have found that the above tendency also prevails in combustion state parameters (hereinafter may be referred to as the "combustion parameters") other than the burning velocity, which are derived from the output of the in-cylinder pressure sensor. More specifically, the inventors of the present invention have found that the same tendency also prevails in various combustion parameters derived from the output of the in-cylinder pressure sensor, such as the in-cylinder pressure (e.g., maximum in-cylinder pressure), internal energy, indicated torque (work), the burning velocity, and the amount of generated heat.

In view of the above circumstances, the air-fuel ratio imbalance detection device, which is used for an internal combustion engine, according to the first embodiment provides control as described below to avoid the above-described decrease in the sensitivity of the combustion parameters in a rich region. First of all, the air-fuel ratio imbalance detection device enleans the air-fuel ratio in each cylinder during an operation of the engine 10. As an example, it is assumed that cylinder #1 is selected from the plurality of cylinders of the engine 10 and enleaned firstly. The cylinder to be subjected to enleaning control according to the first embodiment may be hereinafter referred to as the "target cylinder." At present, cylinder #1 is the target cylinder. Enleaning control is exercised by decreasing the fuel injection amount from the direct-injection injector 14. The fuel injection amount is decreased so that a combustion parameter (the amount of generated heat in the first embodiment) derived from the output of the in-cylinder pressure sensor 16 decreases to a predetermined threshold value.

FIG. 3 is a diagram illustrating how the air-fuel ratio imbalance detection device, which is used for an internal combustion engine, according to the first embodiment decreases the fuel injection amount. The curve in FIG. 3 schematically shows the relationship between the air-fuel ratio and the amount of generated heat Q. As indicated by an arrow in FIG. 3, the first embodiment sets a "threshold value $\alpha$," which represents the amount of generated heat Q that is attained when enleaning control is exercised to obtain a "predetermined lean air-fuel ratio." The "predetermined lean air-fuel ratio" is an air-fuel ratio that is lean enough to avoid the influence of impediments to measurement, such as the sensitivity tolerance and inter-instrument difference in the in-cylinder pressure sensor 16.

The predetermined lean air-fuel ratio and the threshold value $\alpha$ are discussed as above because, in a situation where the air-fuel ratio change toward the lean side is excessively small, air-fuel ratio imbalance detection control might not be exercised with adequate accuracy due to the sensitivity tolerance and inter-instrument difference in the in-cylinder pressure sensor 16. The predetermined lean air-fuel ratio may be hereinafter referred to as the "lean air-fuel ratio for permitting air-fuel ratio detection." As far as the threshold value $\alpha$ is defined in accordance with the above-mentioned "lean air-fuel ratio for permitting air-fuel ratio detection," the air-fuel ratio can be enleaned to achieve adequate detection accuracy when the amount of generated heat Q is decreased to the threshold value $\alpha$ for enleaning purposes.

When the fuel injection amount is reduced until the amount of generated heat Q coincides with the threshold value $\alpha$ as shown in FIG. 3, the cylinder #1 air-fuel ratio prevailing before the fuel injection amount reduction is calculated from the total value of reduction amount of fuel injection amount before such coincidence (injection reduction amount A in FIG. 3). This calculation should be performed by allowing the ECU 50 to memorize a "predetermined function (correlation-defining mathematical expression or map) for determining the air-fuel ratio from injection reduction amount A" and execute it as needed. The "predetermined function" should be prepared in accordance with (in consideration of) the operating conditions, intake temperature, intake pressure, intake air amount, and various other environmental conditions for exercising air-fuel ratio imbalance detection control according to the first embodiment.

FIG. 4 shows an example of a map prepared to calculate the air-fuel ratio for a target cylinder (cylinder #1 in the present example) from the amount of injection reduction A to the threshold value $\alpha$. As a result of calculations performed by using the map or the like, the fuel injection amount for cylinder #1 is reduced so that the amount of generated heat Q coincides with the threshold value $\alpha$. The air-fuel ratio for cylinder #1, which should be used for air-fuel ratio imbalance detection control according to the first embodiment, is calculated from the total value of reduction amount of fuel injection amount mentioned above (injection reduction amount A in FIG. 3).

The above-described series of processing steps is also performed for the remaining cylinders (cylinders #2 to #4). As a result, the air-fuel ratio for each of cylinders #1 to #4 is calculated. The calculated air-fuel ratios can be relatively compared to judge whether there was an air-fuel ratio imbalance between the cylinders before fuel injection amount reduction.

As described above, the air-fuel ratio imbalance detection device, which is used for an internal combustion engine, according to the first embodiment can reduce the fuel injection amount for each cylinder of the engine 10 so that the amount of generated heat Q calculated from the output of the in-cylinder pressure sensor 16 coincides with the predetermined threshold value $\alpha$. More specifically, when there is a significant air-fuel ratio imbalance between the cylinders, the fuel injection amount, which is reduced on an individual cylinder basis until the amount of generated heat Q coincides with the threshold value $\alpha$, should vary to a great extent. As such being the case, the air-fuel ratio imbalance can be detected based on the reduction amount of fuel injection amount during an air-fuel ratio control process of enleaning the air-fuel ratio (injection reduction amount A). Consequently, the air-fuel ratio imbalance between the cylinders can be accurately detected by using the in-cylinder pressure sensor 16.

According to the first embodiment, an air-fuel ratio imbalance within a rich air-fuel ratio region can be detected with adequate accuracy while avoiding the influence of a combustion parameter sensitivity decrease at the aforementioned rich air-fuel ratio. More specifically, as described with reference to FIG. 2, the burning velocity, the amount of generated heat, and various other combustion parameters tend to decrease their sensitivity to an air-fuel ratio change in a certain rich air-fuel ratio region (or more specifically, at an air-fuel ratio of approximately 13). As such a tendency exists, it is difficult to achieve air-fuel ratio imbalance detection with high accuracy even when an attempt is made to achieve air-fuel ratio imbalance detection at a rich air-fuel ratio by resorting to relatively inaccurate combustion parameters derived from a rich air-fuel ratio region. In this respect, however, the first embodiment makes it possible to change the air-fuel ratio toward the lean side, calculate the air-fuel ratio prevailing before enleaning from the reduction amount of fuel injection amount required for the change in the air-fuel ratio, and compare the calculated air-fuel ratio between the individual cylinders to check for an air-fuel ratio imbalance. Consequently, air-fuel ratio imbalance detection can be achieved while avoiding the influence of a combustion parameter sensitivity decrease at a rich air-fuel ratio no matter whether the engine 10 is operated in a stoichiometric, rich, or lean air-fuel ratio region before enleaning (that is, before fuel injection amount reduction).

[Details of Process Performed in First Embodiment]

Figure 5:
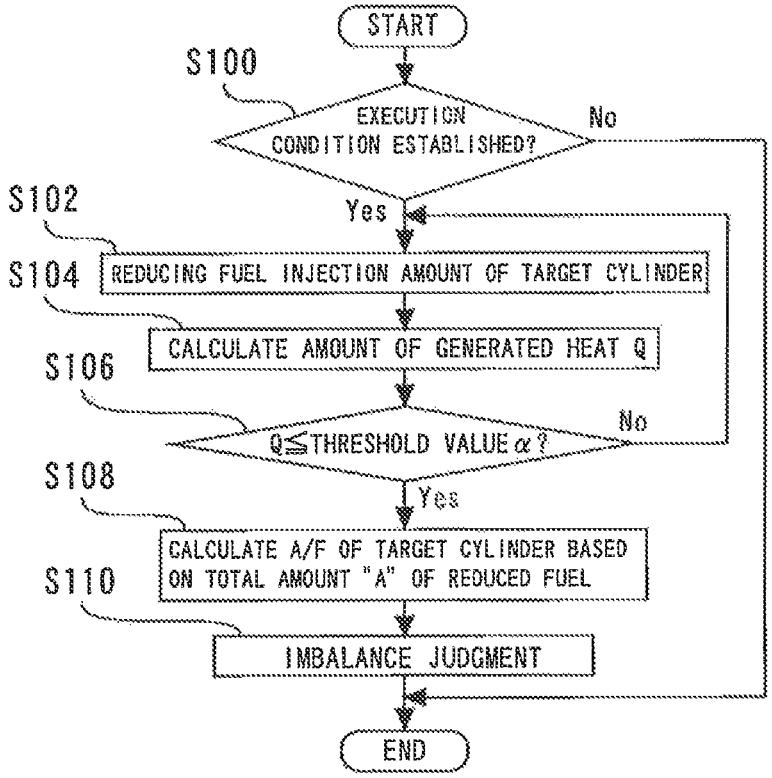
FIG. 5 is a flowchart illustrating a routine executed by the ECU in the air-fuel ratio imbalance detection device for an internal combustion engine, according to the first embodiment of the present invention.

FIG. 5 is a flowchart illustrating a routine executed by the ECU 50 in the air-fuel ratio imbalance detection device for an internal combustion engine, according to the first embodiment of the present invention. The routine is executed at predetermined intervals during an operation of the engine 10.

First of all, the routine shown in FIG. 5 performs step S100. In step S100, the ECU 50 performs a process of judging whether a condition for permitting the execution of air-fuel ratio imbalance detection is established (performs an execution condition judgment process). More specifically, in the first embodiment, the ECU 50 performs this step to judge whether the engine 10 is currently either idling or conducting a steady operation. When the condition in this step is not established, the routine terminates.

When, on the other hand, the condition in step S100 is established, the ECU 50 proceeds to step S102 and performs a process of reducing the fuel injection amount for a target cylinder. In this step, the current target cylinder is determined to specify what number cylinder is targeted. In the first embodiment, cylinder #1 is first set as the target cylinder. In this step, the fuel injection amount for cylinder #1 is reduced by a predetermined amount.

Meanwhile, the ECU 50 continuously executes a program of calculating the amount of generated heat Q in accordance with the output of the in-cylinder pressure 30 sensor 16. In accordance with the process performed in step S102, the ECU 50 proceeds to step S104 and calculates the amount of generated heat Q as a result of combustion according to the fuel injection amount reduced in step S102.

Next, the ECU 50 proceeds to step S106 and performs a process of judging whether the amount of generated heat Q, which was calculated in step S104, is not greater than the threshold value α. When the condition in step S106 is not established, the degree of enleaning is not sufficient to permit the amount of generated heat Q to reach the threshold value α although the fuel injection amount is reduced. In this instance, therefore, processing loops and returns to step S102 so as to further reduce the fuel injection amount. In the first embodiment, when performing step S102 for a second or subsequent time, the ECU 50 increases the amount of fuel injection amount reduction by a predetermined value (performs a reduction amount increase process). When a series of processing steps S102, S104, and S106 is performed, the fuel injection amount can be reduced until the amount of generated heat Q of the target cylinder coincides with the threshold value α. When the condition in step S106 is established, the ECU 50 terminates a process of reducing the fuel injection amount for cylinder #1.

For the sake of brevity, the description of a "target cylinder change" is omitted from the flowchart of FIG. 5. In the first embodiment, however, the ECU 50 performs various steps described in connection with the first embodiment for each cylinder. In other words, the ECU 50 performs steps S102 to S106 for each cylinder to reduce the fuel injection amount, check whether the amount of generated heat coincides with the threshold value α, and calculate the air-fuel ratio for the target cylinder. More specifically, while changing the "target cylinder" one by one in a predetermined order, the ECU 50 performs steps S102, S104, S106, and S108, which are shown in FIG. 5, at least once for each of cylinders #1 to #4. Alternatively, a plurality of cylinders may be designated as target cylinders and processed in a parallel manner. After the "reduction amount of fuel injection amount for permitting the amount of generated heat Q to coincide with the threshold value α" is obtained for necessary cylinders (cylinders #1 to #4 in the first embodiment), processing proceeds to step S108.

When processing proceeds to step S108 as a result of the above process, the reduction amount of fuel injection amount (injection reduction amount A in FIG. 3) is obtained for each cylinder. Next, the ECU 50 proceeds to step S108 and performs a process of calculating the air-fuel ratio for the target cylinder in accordance with total injection reduction amount A. As a premise for the process performed in step S108, the ECU 50 stores a map, mathematical expression, and other functions that are prepared to calculate the air-fuel ratio for the target cylinder from injection reduction amount A for attaining the threshold value α as described with reference to FIG. 4. The ECU 50 calculates the air-fuel ratio for each of cylinders #1 to #4 in accordance with the stored functions. This makes it possible to obtain the air-fuel ratio information about each cylinder, which is required to check for an imbalance.

Next, the ECU 50 proceeds to step S110 and performs a process of formulating an imbalance judgment. As a premise for the process performed in step S110, the ECU 50 stores a process of evaluating the variation of the air-fuel ratios (e.g., checking whether the variation is within a predetermined range) by comparing the air-fuel ratios calculated in step S108 for cylinders #1 to #4. This imbalance judgment process should be prepared in accordance with judgment criteria for determining whether there is an air-fuel ratio imbalance between the cylinders. Upon completion of step S110, the routine terminates.

According to the above-described process, the fuel injection amount for each cylinder of the engine 10 can be reduced so that the amount of generated heat Q, which is calculated from the output of the in-cylinder pressure sensor 16, coincides with the threshold value α. This makes it possible to accurately detect an air-fuel ratio imbalance between the cylinders by using the in-cylinder pressure sensor 16.

Further, according to the above-described process, steps S102 to S106 are performed for each cylinder so that the ECU 50 reduces the fuel injection amount from the direct-injection injector 14 for each of the plurality of the cylinders of the engine 10. After initiating this process of reducing the fuel injection amount, the ECU 50 performs a judgment process in step S106 by comparing a combustion parameter (the amount of generated heat Q) against the threshold value α. In step S106, the ECU 50 terminates a fuel injection amount reduction control process in accordance with the result of comparison between the amount of generated heat Q and the threshold value α. Performing a series of the above-described processing steps makes it possible to accurately judge whether the combustion parameter (the amount of generated heat Q) coincides with the threshold value α in each cylinder and steadily enlean the air-fuel ratio as desired in accordance with the threshold value α.

Furthermore, according to the above-described process, the reduction of the fuel injection amount starts in step S102, which is the initial step, and subsequently comes to a stop in step S106 in which the amount of generated heat Q coincides with the threshold value α. As described above, the start and end points of fuel injection amount reduction can be clearly determined by continuously calculating and monitoring the combustion parameter (the amount of generated heat Q) in accordance with the output of the in-cylinder pressure sensor 16. This makes it possible to precisely determine the reduction amount of fuel injection amount (the amount of change in the fuel injection fuel amount) and accurately calculate the air-fuel ratio information to be used for air-fuel ratio imbalance detection on an individual cylinder basis.

Moreover, according to the above-described process, processing loops when the condition in step S106 is not established (that is, when the amount of generated heat Q is greater than the threshold value α) so that the ECU 50 performs a process of increasing the reduction amount of fuel injection amount by a predetermined value (performs the reduction amount increase process) when step S102 is performed for a second time. Consequently, the result of comparison between the combustion parameter (the amount of generated heat Q) and the threshold value α can be properly fed back to fuel injection amount reduction control.

In addition, according to the above-described process, one of cylinders #1 to #4 of the engine 10 can be selected as the target cylinder and subjected to the processes in steps S102, S104, and S106. Subsequently, the air-fuel ratio information to be used for air-fuel ratio imbalance detection can be acquired on an individual cylinder basis while changing the target cylinder.

In the first embodiment described above, the in-cylinder pressure sensor 16 corresponds to the "in-cylinder pressure sensor" according to the first aspect of the present invention; and the program for calculating the amount of generated heat Q, which is stored in the ECU 50, corresponds to the "calculation means" according to the first aspect of the present invention. Further, in the first embodiment described above, the "injection amount control means" according to the first aspect of the present invention is implemented when the ECU 50 performs steps S102, S104, and S106; and the "imbalance detection means" according to the first aspect of the present invention is implemented when the ECU 50 performs steps S108 and S110. Furthermore, in the first embodiment described above, the amount of generated heat Q corresponds to the "combustion parameter" according to the first aspect of the present invention; and the threshold value α corresponds to the "predetermined value" according to the first aspect of the present invention.

[Example Modifications of First Embodiment]

In the first embodiment, the ECU 50 executes the program that calculates the amount of generated heat Q as a combustion parameter in accordance with the output of the in-cylinder pressure sensor 16. However, the present invention is not limited to such program execution. The ECU 50 may store a calculation program that calculates a different combustion parameter in accordance with the output of the in-cylinder pressure sensor 16. More specifically, the ECU 50 may store a calculation program that calculates one or more combustion parameters such as the in-cylinder pressure, maximum in-cylinder pressure, internal energy, indicated torque, indicated work, or burning velocity. Alternatively, the ECU 50 may store a program that calculates physical quantities correlated with the above-mentioned combustion parameters.

The internal combustion engine system according to the first embodiment is configured as a sub-feedback air-fuel ratio control system that uses the catalyst downstream exhaust sensor 35 as a so-called sub-oxygen sensor. However, the present invention is not limited to such a configuration. The exhaust system may be configured to have only one exhaust path catalyst or only one exhaust gas sensor other than the configuration in the first embodiment. Although the system according to the first embodiment directly injects gasoline from a fuel injection valve to a combustion chamber, a system capable of injecting the gasoline into an intake port of the intake path may be used. A system capable of port injection and in-cylinder injection may be used.

Second Embodiment

The air-fuel ratio imbalance detection device, which is used for an internal combustion engine, according to a second embodiment of the present invention and the internal combustion engine system to which the air-fuel ratio imbalance detection device is applied are configured so as to include the same hardware configurations as the counterparts according to the first embodiment. The hardware configurations will be briefly described or omitted from the subsequent description to avoid redundancy. In the second embodiment, which is described below, the ECU 50 performs a process of calculating the threshold value α for enleaning from a detectable lean air-fuel ratio on the basis of the idea that the average amount of heat generated in all cylinders correlates with an exhaust air-fuel ratio (which is an air-fuel ratio based on the output of the catalyst upstream exhaust sensor 33 as an air-fuel ratio sensor). Hence, even when the appropriate threshold value α for the amount of generated heat changes with the operating conditions, an air-fuel ratio imbalance can be accurately detected irrespective of such changes.

Figure 6:
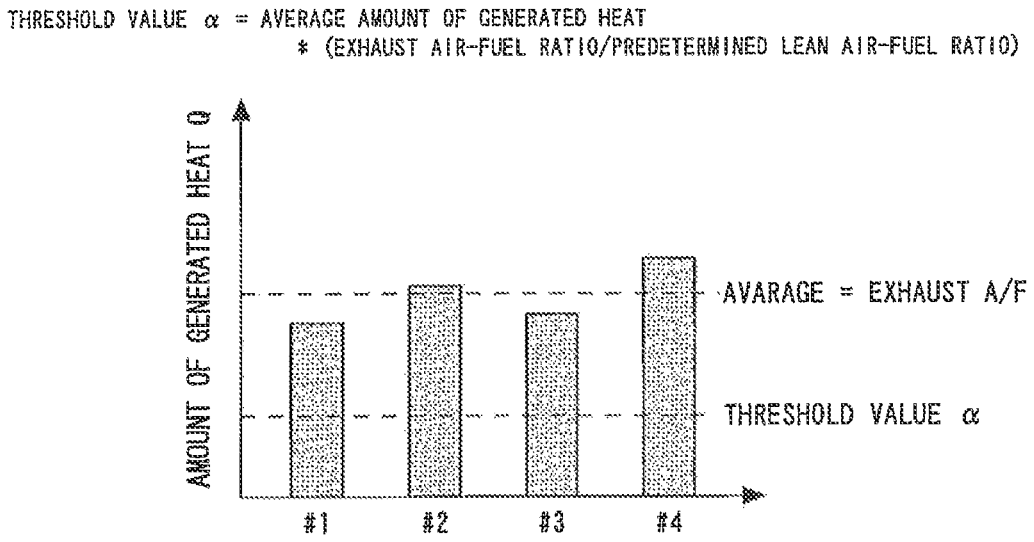
FIG. 6 is a diagram illustrating a control operation performed by the air-fuel ratio imbalance detection device, which is used for an internal combustion engine, according to a second embodiment of the present invention.
Figure 7:
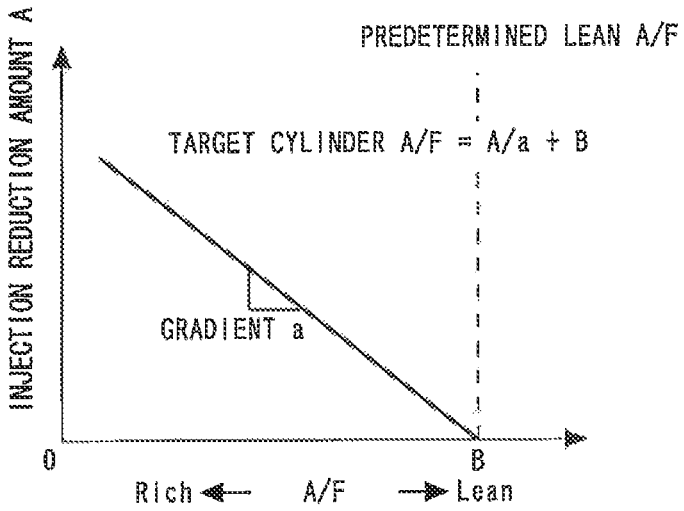
FIG. 7 is a diagram illustrating a control operation performed by the air-fuel ratio imbalance detection device for an internal combustion engine, according to the second embodiment of the present invention.

FIGS. 6 and 7 are diagrams illustrating how a control operation is performed by the air-fuel ratio imbalance detection device for an internal combustion engine, according to the second embodiment of the present invention. More specifically, FIG. 6 is a diagram illustrating a threshold value calculation method according to the second embodiment. In FIG. 6, a broken line marked "Average value=Exhaust A/F" (the upper broken line in FIG. 6) schematically indicates the value of an air-fuel ratio sensed by the catalyst upstream exhaust sensor 33. On the other hand, a broken line marked "Threshold value α" in FIG. 6 (the lower broken line in FIG. 6) indicates the threshold value a calculated by a threshold value calculation method according to the second embodiment. The calculated threshold value α is commonly applied to cylinders #1 to #4.

In the first embodiment, the threshold value α is set in accordance with a "lean air-fuel ratio at which air-fuel ratio detection can be achieved" and used by the ECU 50 to execute the flowchart of FIG. 5. In the second embodiment, on the other hand, the threshold value α is set (updated) to an appropriate value in accordance with Equation (1) below each time a control flowchart is executed.

$$\text{Threshold value } \alpha = \text{average amount of generated heat} \times (\text{exhaust air-fuel ratio}/\text{predetermined lean air-fuel ratio}) \quad (1)$$

In Equation (1), the "average amount of generated heat" is the average value of the amounts of generated heat Q that are calculated from the outputs of the in-cylinder pressure sensors 16 for cylinders #1 to #4. In other words, when the amounts of heat generated in cylinders #1, #2, #3, and #4 are Q1, Q2, Q3, and Q4, respectively, the average amount of generated heat is the average value of Q1, Q2, Q3, and Q4.

The "exhaust air-fuel ratio" is an air-fuel ratio that is detected from exhaust gas introduced into the exhaust path 32. As the catalyst upstream exhaust sensor 33 (air-fuel ratio sensor) is disposed in the exhaust path 32 into which the exhaust gas from each of cylinders #1 to #4 flows, the air-fuel ratio detected from the output of the catalyst upstream exhaust sensor 33 can be used as the "exhaust air-fuel ratio."

The "predetermined lean air-fuel ratio" is an air-fuel ratio that is, as described in connection with the first embodiment, lean enough to avoid the influence of impediments to measurement, such as the sensitivity tolerance and inter-instrument difference in the in-cylinder pressure sensor 16. The value of the predetermined lean air-fuel ratio should be preset.

When Equation (1) is used, the threshold value α, which serves as a target value for the amount of generated heat Q, can be calculated from the present average amount of generated heat so that the present exhaust air-fuel ratio can be enleaned to the predetermined lean air-fuel ratio.

In the second embodiment, Equation (2) below is used to calculate the air-fuel ratio for the target cylinder. FIG. 7 shows the relationship defined by Equation (2), that is, a scheme for calculating the air-fuel ratio for the target cylinder from injection reduction amount A with reference to the lean air-fuel ratio at which air-fuel ratio detection can be achieved (predetermined lean air-fuel ratio B).

$$\text{Target cylinder air-fuel ratio} = A/a + B \quad (2)$$

In Equation (2), the symbol "A" is the same as "injection reduction amount A" in step S108 of the first embodiment and indicative of the total amount of reduction provided by fuel injection amount reduction for enleaning. The symbol "a" is a predetermined gradient of correlation between injection amount and air-fuel ratio. The symbol "B" is a predetermined detectable lean air-fuel ratio, that is, the predetermined lean air-fuel ratio.

Figure 8:
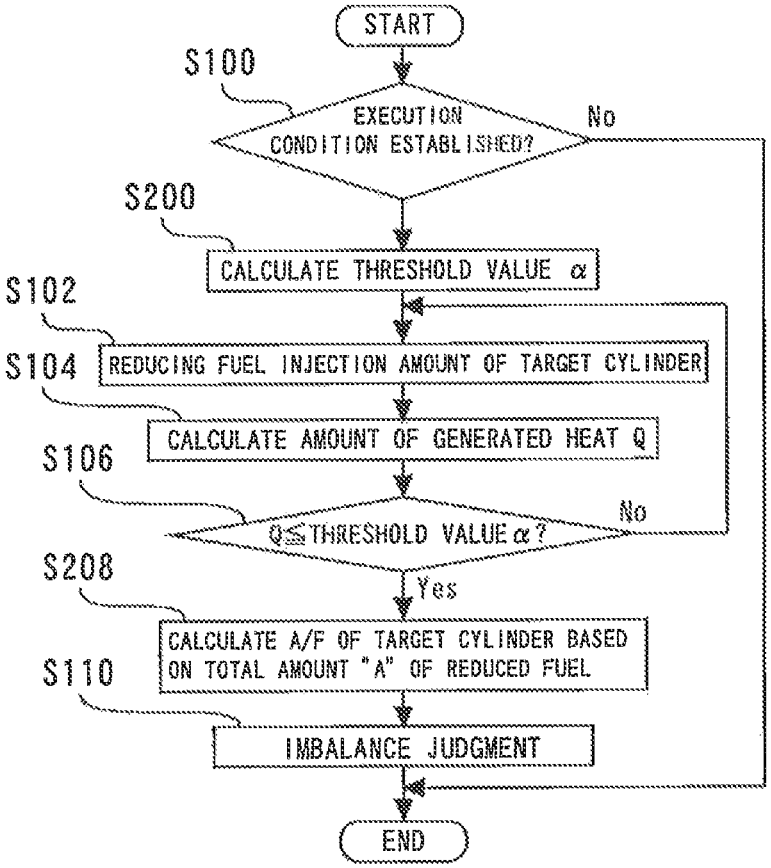
FIG. 8 is a flowchart illustrating a routine executed by the ECU in the air-fuel ratio imbalance detection device for an internal combustion engine, according to the second embodiment of the present invention.

FIG. 8 is a flowchart illustrating a routine executed by the ECU 50 in the air-fuel ratio imbalance detection device for an internal combustion engine, according to the second embodiment of the present invention. The routine is executed at predetermined intervals during an operation of the engine 10. The routine shown in FIG. 8 causes the ECU 50 to perform a process of calculating the threshold value α in accordance with Equation (1) in step S200 and perform a process of calculating the air-fuel ratio for the target cylinder in accordance with Equation (2) in step S208. The other steps are the same as the corresponding steps in the flowchart of the routine according to the first embodiment.

The air-fuel ratio imbalance detection device according to the second embodiment is capable of calculating a target value (threshold value α) for a combustion parameter in accordance with the predetermined lean air-fuel ratio during an operation of the engine 10 by using an "average air-fuel ratio detected from exhaust gas introduced from cylinders #1 to #4" and an "average value of the combustion parameters (the amounts of generated heat Q) for cylinders #1 to #4." In the second embodiment, various parameters other than the amount of generated heat may also be used, as is the case with the first embodiment. Further, the second embodiment may be variously modified in the same manner as for the first embodiment.

REFERENCE SIGNS LIST

10 engine
12 ignition plug
14 direct-injection injector
16 in-cylinder pressure sensor
18 crank angle sensor
20 intake path
22 air cleaner
24 air flow meter
26 throttle valve
27 throttle opening sensor
28 surge tank
30 intake pressure sensor
32 exhaust path
33 catalyst upstream exhaust sensor
34, 36 catalyst
35 catalyst downstream exhaust sensor
50 ECU (electronic control unit)

The invention claimed is:

1. An air-fuel ratio imbalance detection device for an internal combustion engine, comprising a controller configured to perform a method including:

acquiring an output from an in-cylinder pressure sensor mounted on each of a plurality of cylinders of the internal combustion engine;

calculating a combustion parameter including an amount of generated heat within the plurality of cylinders based on an output of the in-cylinder pressure sensor;

providing control to enlean an air-fuel ratio for each of the plurality of cylinders by reducing a fuel injection amount so that the amount of generated heat coincides with a predetermined amount of generated heat;

responsive to determining that the amount of generated heat coincides with the predetermined amount of generated heat, detecting an air-fuel ratio imbalance between the plurality of cylinders based on a reduction amount of fuel injection amount, the reduction amount being provided by control that is exercised for each of the plurality of cylinders;

receiving output of an air-fuel ratio sensor disposed in an exhaust path into which exhaust gas from the plurality of cylinders is introduced; and calculating the predetermined amount of generated heat with which the amount of generated heat should coincide under the control based on a ratio and an average value, the ratio being between an air-fuel ratio value that is obtained based on the output of the air-fuel ratio sensor and a predetermined lean air-fuel ratio value, the average value being an average of the amount of generated heat for the plurality of cylinders.

2. The air-fuel ratio imbalance detection device for an internal combustion engine, according to claim 1, wherein the method further includes:

reducing the fuel injection amount for each of the plurality of cylinders;

comparing the amount of generated heat against the predetermined amount of generated heat after a start of reduction by the reducer; and terminating the reduction by the reducer based on a result of the comparison.

3. The air-fuel ratio imbalance detection device for an internal combustion engine according to claim 2, wherein the method further includes:

calculating an air-fuel ratio for a cylinder subjected to fuel injection amount reduction, based on the reduction amount of fuel injection amount from a start of the fuel injection amount reduction to an end of the fuel injection amount reduction.

4. The air-fuel ratio imbalance detection device for an internal combustion engine according to claim 2, wherein the method further includes:

reducing the fuel injection amount by a predetermined amount at a beginning of fuel injection amount reduction; and increasing an amount of the reduction when the result of comparison made indicates that the amount of generated heat is greater than the predetermined amount of generated heat.

5. The air-fuel ratio imbalance detection device for an internal combustion engine, according to claim 1, wherein the method further includes:

reducing the fuel injection amounts for the plurality of cylinders so that the amount of generated heat for a target cylinder coincides with a predetermined amount of generated heat, the target cylinder being selected from the plurality of cylinders; and selecting a target cylinder from the plurality of cylinders such that each of the plurality of cylinders is selected as the target cylinder at least once during a period of operation;

calculating the reduction amount of fuel injection amount for the target cylinder applied to the control;

acquiring a calculated value of an air-fuel ratio for the target cylinder based on the reduction amount of fuel injection amount, the calculated value of the air fuel ratio being an air fuel ratio of the target cylinder before the target cylinder is controlled; and detecting an air-fuel ratio imbalance between the plurality of cylinders based on a comparison of the calculated values of the air-fuel ratios between the plurality of cylinders.

6. The air-fuel ratio imbalance detection device for an internal combustion engine according to claim 1, wherein the combustion parameter further includes at least one of quantities selected from a group of an in-cylinder pressure, internal energy, indicated torque, indicated work, and a burning velocity, or a physical quantity correlated with at least one of the quantities selected from the group.

7. A non-transitory computer-readable medium storing instructions that, when executed by a controller, cause the controller to perform a method comprising:

acquiring an output from an in-cylinder pressure sensor mounted on each of a plurality of cylinders of an internal combustion engine;

calculating a combustion parameter including an amount of generated heat within the plurality of cylinders based on an output of the in-cylinder pressure sensor;

providing control to enlean an air-fuel ratio for each of the plurality of cylinders by reducing a fuel injection amount so that the amount of generated heat calculated coincides with a predetermined amount of generated heat; and responsive to determining that the amount of generated heat coincides with the predetermined amount of generated heat, detecting an air-fuel ratio imbalance between the plurality of cylinders based on a reduction amount of fuel injection amount, the reduction amount being provided by control that is exercised for each of the plurality of cylinders by the injection amount controller;

receiving output of an air-fuel ratio sensor disposed in an exhaust path into which exhaust gas from the plurality of cylinders is introduced; and calculating the predetermined amount of generated heat with which the amount of generated heat should coincide under the control based on a ratio and an average value, the ratio being between an air-fuel ratio value that is obtained based on the output of the air-fuel ratio sensor and a predetermined lean air-fuel ratio value, the average value being an average of the amount of generated heat for the plurality of cylinders.

* * * * *